United States Patent [19]

Minagawa et al.

[11] Patent Number: 4,903,646

[45] Date of Patent: Feb. 27, 1990

[54] V-TYPE CYLINDER BLOCK OF INTERNAL COMBUSTION ENGINE

[75] Inventors: Shunichi Minagawa, Kawasaki; Hiroaki Kuzuoka, Yokohama; Hitoshi Nakamura, Yokohama; Etsuo Ogami, Yokohama, all of Japan

[73] Assignee: Nissan Motor Co., Ltd., Yokohama, Japan

[21] Appl. No.: 333,419

[22] Filed: Apr. 4, 1989

[30] Foreign Application Priority Data

Apr. 6, 1988 [JP] Japan ..... 63-46482[U]

[51] Int. Cl.[4] ..... F02B 75/22

[52] U.S. Cl. ..... 123/55 VE; 123/195 R; 123/425; 73/35

[58] Field of Search ..... 123/55 VS, 55 VF, 55 VE, 123/195 R, 425; 73/35

[56] References Cited

U.S. PATENT DOCUMENTS

| | | | |
|---|---|---|---|
| 3,183,794 | 5/1965 | Hind | 123/195 R |
| 4,468,950 | 9/1984 | Ishigami et al. | 73/35 |
| 4,475,508 | 10/1984 | Okada | 123/425 |
| 4,494,494 | 1/1985 | Yahiro et al. | 123/55 VS |
| 4,517,945 | 5/1985 | Ishigami et al. | 123/425 |
| 4,627,394 | 12/1986 | Asanomi et al. | 123/195 R |
| 4,712,517 | 12/1987 | Anno et al. | 123/195 R |
| 4,779,588 | 10/1988 | Ziegler et al. | 123/41.61 |
| 4,805,442 | 2/1989 | Okumura et al. | 73/35 |

FOREIGN PATENT DOCUMENTS

| | | |
|---|---|---|
| 59-106029 | 7/1984 | Japan . |
| 60-170048 | 11/1985 | Japan . |

*Primary Examiner*—Charles J. Myhre
*Assistant Examiner*—Weilun Lo
*Attorney, Agent, or Firm*—Foley & Lardner, Schwartz, Jeffery, Schwaab, Mack, Blumenthal & Evans

[57] ABSTRACT

A V-type cylinder block of internal combustion engine is disclosed, which provides two angularly disposed cylinder banks each having a cylinder row of cylinders. A plurality of ribs rise generally from head bolt hole portions defined between two cylinders adjacent each other, are provided between two cylinder rows for interconnecting wall portions of the cylinder rows and intersect at the middle of the cylinder rows for forming intersecting points. At the intersecting points of the plurality of ribs are disposed fixing portions of knocking sensors for detecting an engine knocking.

2 Claims, 4 Drawing Sheets

V-TYPE CYLINDER BLOCK OF INTERNAL COMBUSTION ENGINE

BACKGROUND OF THE INVENTION

1. Field of the Invention

The present invention relates to improvements in a V-type cylinder block of internal combustion engine.

2. Description of the Prior Art

Among various kinds of V-type cylinder blocks of internal combustion engine having two cylinder rows angularly arranged with respect to a crank shaft, a cylinder block 1 as shown in FIG. 4 has been widely used. This cylinder block 1 comprises two cylinder banks angularly disposed with respect to a crank shaft 2, each having cylinders 3 to 5 in a cylinder row 6 and cylinders 7 to 9 in a cylinder row 10. Cylinder heads (not shown) are respectively connected to an upper portion of the cylinders by head bolts (refer to Japanese Preliminary Utility Model Publication No. 60-170048).

In this prior art, a plurality of ribs 11 are formed between the cylinder rows 6 and 10 to increase the strength of the cylinder block 1. However, since each of the ribs 11 is arranged parallel between wall portions of the cylinder rows 6 and 10, it does not have much restraint to torsional vibration generated by combustion in each of the cylinders 3 to 5 and 7 to 9 resulting in deformation of the cylinder block 1.

Recently, a knocking sensor provided on a cylinder block is used for detecting an engine knocking. With such V-type cylinder block 1, the knocking sensor must be disposed every cylinder, causing cost increase.

There is another cylinder block having, between the cylinder rows, a plate portion which is connected with each rib and provides the knocking sensors. With this cylinder block, also, it is impossible to reduce torsional deformation of the cylinder block. Additionally, the engine knocking is detected through the plate portion so that it is difficult to precisely detect the knocking of each of the cylinders (refer to Japanese Preliminary Utility Model Publication No. 59-106029).

It is, therefore, an object of the present invention to provide a V-type cylinder block of internal combustion engine which is free of the aforementioned problems.

SUMMARY OF THE INVENTION

For achieving the above-mentioned object, there is provided, according to the present invention, a V-type cylinder block of internal combustion engine, comprising:

two angularly disposed cylinder banks each having a cylinder row of cylinders;

a plurality of ribs, said plurality of ribs rising generally from head bolt hole portions defined between two cylinders adjacent each other, said plurality of ribs being provided between two cylinder rows for interconnecting wall portions of said cylinder rows, said plurality of ribs intersecting at the middle of said cylinder rows for forming intersecting points.

DETAILED DESCRIPTION OF THE INVENTION

Figure 1:
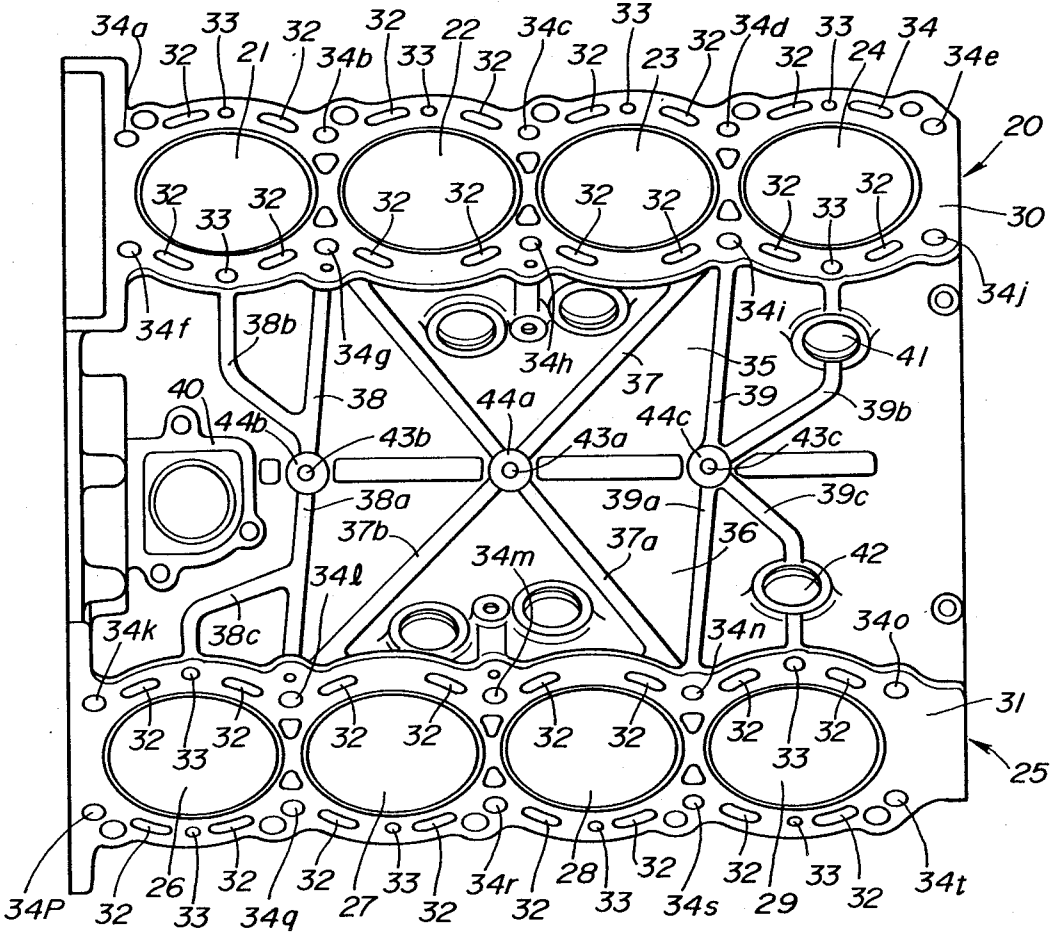
FIG. 1 is a plan view of an embodiment of a V-type cylinder block of internal combustion engine according to the present invention.

Referring to FIG. 1, there is shown an embodiment of a cylinder block of V-type eight-cylinder engine according to the present invention, which provides two angularly disposed cylinder banks, each having a cylinder row 20 of cylinders 21 to 24 and a cylinder row 25 of cylinders 26 to 29. In an upper portion of each of the cylinder rows 20 and 25 are formed decks 30 and 31 for mounting a cylinder head (not shown), which have a plurality of water holes 32 and a plurality of oil holes 33 and head bolt holes 34*a* to 34*t* in connection with each cylinder. Between a bore wall portion of each of the cylinders 21 to 24 and 26 to 29 and a wall portion of each of the cylinder rows 20 and 25, a water jacket (not shown) is formed and fluidly connected with the water holes 32. Additionally, the water jacket is separated from the head bolt holes 34*a* to 34*t* and the oil holes 33 by partition walls. Ribs 37 to 39 are provided between the cylinder rows 20 and 25 for interconnecting wall portions 35 and 36 thereof. The rib 37 consists of two rib portions 37*a* and 37*b* which intersect at the middle of the cylinder rows 20 and 25, the portion 37*a* extending generally from the head bolt hole 34*g* to the hole 34*n* while the portion 37*b* generally from the hole 34*i* to the hole 34*l*. The rib 38 consists of three rib portions 38*a*, 38*b* and 38*c*, the portion 38*a* extending generally from the head bolt hole 34*g* to the hole 34l while the portions 38*b* and 38*c* rising generally from the oil hole 33 by the cylinder 21 and the hole 33 by the cylinder 26 respectively and coming obliquely to the portion 38*a*. If a fixture 40 for mounting accessories is not obstructive of each course of the rib portions 38*b* and 38*c*, these portions may be connected with the rib portion 38*a* at the middle of the cyliner rows 20 and 25. The rib 39 also consists of three rib portions 39*a*, 39*b* and 39*c*, the portion 39*a* extending generally from the head bolt hole 34*i* to the hole 34*n* while the portions 39*b* and 39*c* rising generally from the oil hole 33 by the cylinder 24 and the hole 33 by the cylinder 29 respectively and coming obliquely to the portion 39*a*. Holes 41 and 42 for supporting cores during casting of the cylinder block are thick in circumference thereby to form parts of the rib portions 39*b* and 39*c*. At the center of the ribs 37 to 39 (middle of the cylinder rows 20 and 25) are disposed bosses 44*a* to 44*c* having fixing portions 43*a* to 43*c* such as tapped hole of knocking sensors (not shown).

As described above, since the X-shaped rib 37 is formed between the cylinder rows 20 and 25, strength and/or rigidity of the cylinder block are highly increased. Additionally, the ribs 38 and 39 disposed on either side of the rib 37 contribute to improvements in strength and/or rigidity of the block.

Figure 2:
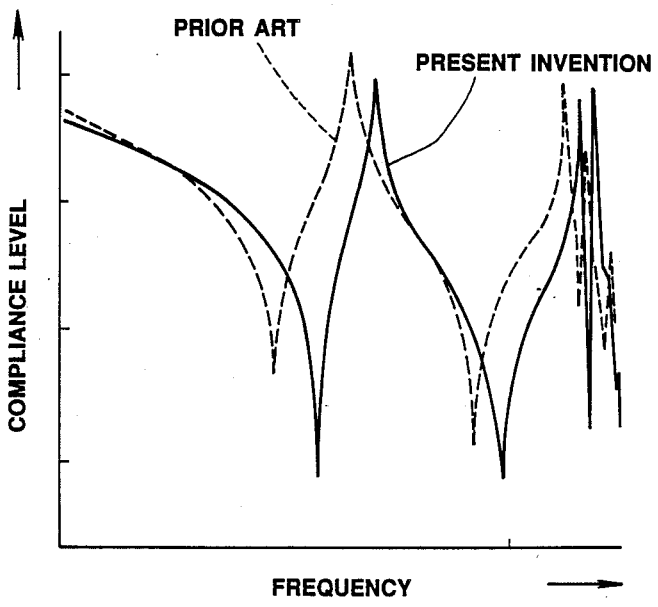
FIG. 2 is a diagram showing a vibration characteristic.

Accordingly, torsional vibration generated by combustion in each of the cylinders 21 to 24 and 25 to 29 can be greatly limited, resulting in a reduction in torsional deformation of the cylinder block. As seen from FIG. 2, compliance level (displacement for unit exciting force) is more reduced and resonance frequency is more increased in the cylinder block of the present invention than in the conventional cylinder block. In other words, with the cylinder block of the present invention, it is possible to greatly reduce torsional vibration and deformation and also sounds due to vibration.

The rib 37 rises generally from the head bolt holes 34*g*, 34*i*, 34*l* and 34*n* which are high in strength so that excessive force may not act on the wall portions 35 and 36.

With the knocking sensors arranged as mentioned above, knocking vibration generated in the cylinders 21 and 26 is detected by the sensor of the boss 44*b* through the rib 38, knocking vibration generated in the cylinders 22, 23, 27 and 28 by the sensor of the boss 44*a* through the rib 37 and knocking vibration generated in the cylinders 24 and 29 by the sensor of the boss 44*c* through the rib 39. Thus, a small number of knocking sensors are sufficient to precisely detect the engine knocking in each of the cylinders.

Figure 3:
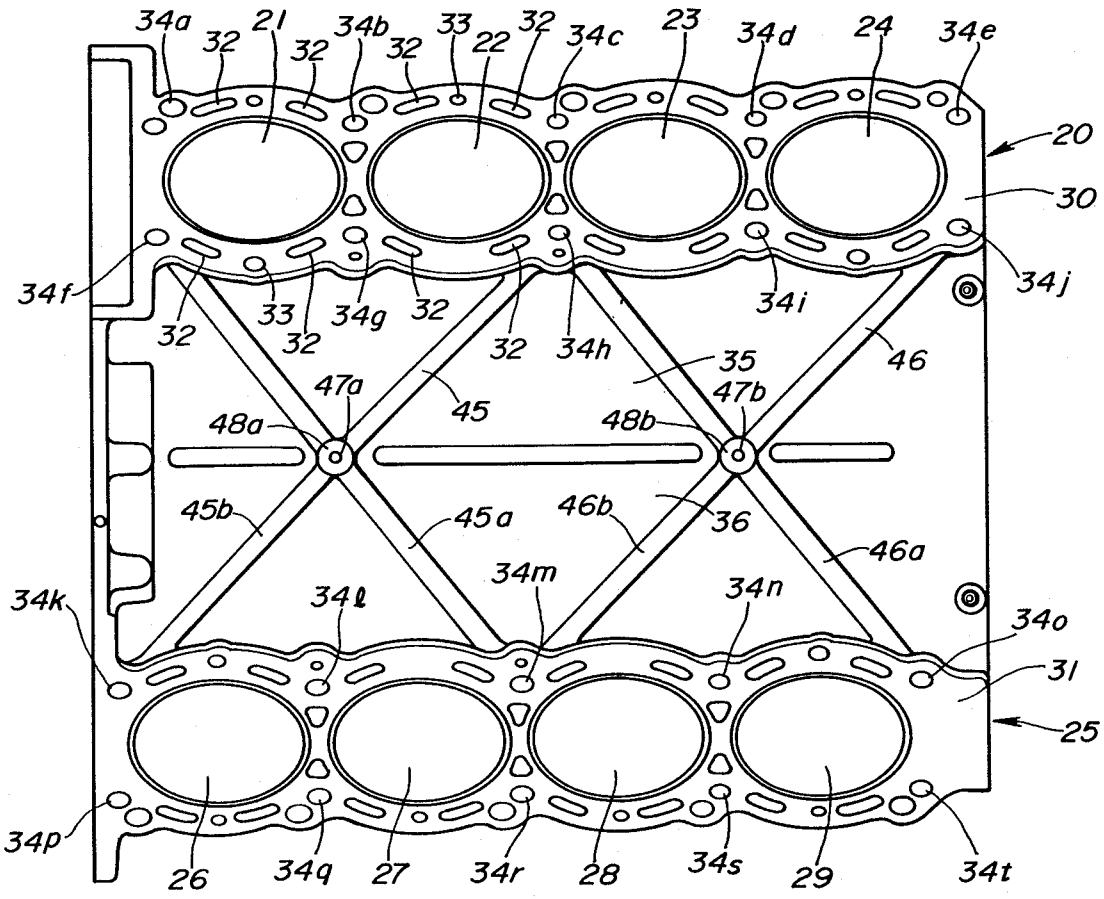
FIG. 3 is a plan view of another embodiment of a V-type cylinder block according to the present invention.
Figure 4:
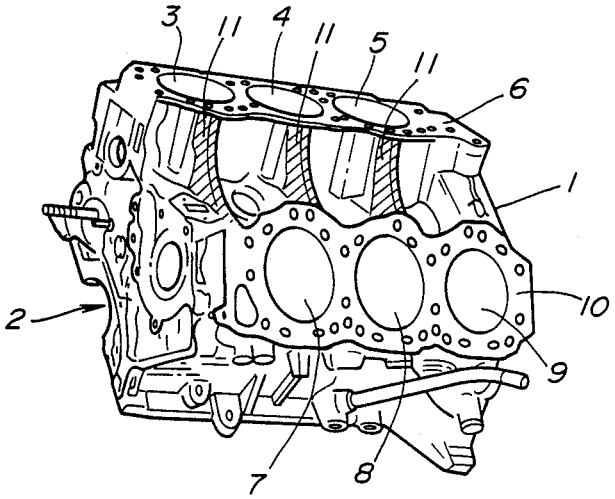
FIG. 4 (PRIOR ART)
FIG. 4 is a perspective view showing a V-type cylinder block of the prior art.

Referring to FIG. 3, there is shown another embodiment of a cylinder block of V-type eight-cylinder engine according to the present invention, which provides two X-shaped ribs 45 and 46 connecting between wall portions 35 and 36 of two cylinder rows 20 and 25. The rib 45 consists of two rib portions 45*a* and 45*b*, the portion 45*a* extending generally a head bolt hole 34*f* to a hole 34*m* while the portion 45*b* generally from a head bolt hole 34*h* to a hole 34*k*. The rib 46 consists of two rib portions 46*a* and 46*b*, the portion 46a extending generally from a head bolt hole 34*h* to a hole 34*o* while the rib 46*b* geneally from a head bolt hole 34*j* to a hole 34*m*. At the center of the ribs 45 and 46 are disposed bosses 48*a* and 48*b* having fixing portions 47*a* and 47*b* of knocking sensors.

In such arrangement, torsional strength and/or rigidity can be further increased with a reduced number of knocking sensors.

What is claimed is:

1. A V-type cylinder block of internal combustion engine, comprising:

two angularly disposed cylinder banks each having a row of cylinders;

a plurality of ribs, said plurality of ribs rising generally from head bolt hole portions defined between two cylinders adjacent each other, said plurality of ribs being provided between said two cylinder banks for interconnecting wall portions of said cylinder banks, said plurality of ribs intersecting at the middle of said cylinder rows for forming intersecting points.

2. A V-type cylinder block of internal combustion engine according to claim 1, wherein at said intersecting points of said plurality of ribs are disposed fixing portions of knocking sensors for detecting an engine knocking.

* * * * *